United States Patent [19]

Feathers

[11] 4,327,851

[45] May 4, 1982

[54] BACK-CARRYING HARNESS ASSEMBLIES

[75] Inventor: Leonard J. Feathers, Henfield, England

[73] Assignee: Chubb Panorama Limited, Sussex, England

[21] Appl. No.: 186,801

[22] Filed: Sep. 12, 1980

[30] Foreign Application Priority Data

Sep. 12, 1979 [GB] United Kingdom ..... 31693/79
Nov. 30, 1979 [GB] United Kingdom ..... 41338/79

[51] Int. Cl.[3] ..... A45F 3/00
[52] U.S. Cl. ..... 224/211; 224/212
[58] Field of Search ..... 224/211, 209, 210, 212, 224/259, 261, 262, 271

[56] References Cited

U.S. PATENT DOCUMENTS 2,675,150 4/1954 Ackerman ..... 224/212 X
3,265,260 8/1966 Romney ..... 224/212 X
3,957,183 5/1976 Gadberry ..... 224/211
4,049,164 9/1977 Sullivan et al. ..... 224/211

*Primary Examiner*—Steven M. Pollard
*Attorney, Agent, or Firm*—Pollock, Vande Sande & Priddy

[57] ABSTRACT

A back-carrying harness assembly, e.g. for supporting a gas cylinder for breathing apparatus on the back of the user, comprises a carrier for the cylinder or other load which is hinged in the region of the user's shoulder blades to a back plate. The back plate extends down the back of the user and is hinged at the lumbar region to the frame of a pelvic girdle. The combined effect of the upper and lower hinging with the location of the girdle, which supports the greater part of the loading of the carrier, low down on the user's anatomy, allows a considerable degree of freedom of movement to the user.

13 Claims, 18 Drawing Figures

16
15
1
14
2
19
4
7
17
5
12
23
6
11

111
112
102
111
109
108
110
107
101
114
113
104
119
118
A
117
116
115
114
105

107
109
110
106
109
111
112
111
108
103

BACK-CARRYING HARNESS ASSEMBLIES

This invention relates to back-carrying harness assemblies.

The invention is especially applicable to back-carrying harness assemblies of breathing apparatus where a bottle or cylinder of gas is to be carried on the back of the user. However the invention is applicable to other circumstances where a cylinder or other load is to be carried on the back.

According to the invention there is provided a back-carrying harness assembly for supporting a load on the back of a user, wherein a carrier for the load is hinged to another part of the assembly that is arranged to be harnessed to lie against the back of the user.

The said part of the assembly may be a plate or other member that is for harnessing to the user with the carrier-hinging located in the region of the user's shoulder blades. This plate or other member in the worn assembly may extend down the user's back and may be further hinged to a main element of the harnessing. In particular this main element of the harnessing may be provided by a pelvic girdle having a frame to which the plate or other member is hinged in a location corresponding to that of the user's lumbar region. The plate or other member may be pulled up into the user's back by shoulder straps that are attached to the carrier at a location which in the worn assembly lies above the hinging of the carrier to the plate or other member, and which may pass down over the shoulders for attachment to the aforesaid pelvic girdle.

Where a pelvic girdle as referred to above is used, this may incorporate a frame having an upper portion for extending transversely of the user's back and further portions for extending downwardly from the upper portion on both sides in the region of the user's hips. A flexible basket or cradle of webbing or other material may then be provided within the frame to seat on the upper part of the user's buttocks for supporting at least a substantial proportion of the load carried by the carrier.

An advantage of a back-carrying harness assembly in accordance with the invention is that it may confer upon the user a greater degree of freedom of movement than conventional forms of back-carrying harness employed with breathing apparatus, as will become more apparent from the ensuing particular description of preferred embodiments of the invention taken in conjunction with the accompanying drawings, in which.

The respective breathing apparatus of which each back-carrying harness assembly to be described forms part, includes a respiratory system that is supplied with breathing gas from a cylinder carried in the conventional inverted, upright attitude on the back of the user of the apparatus. The back-carrying harness assembly is utilized in supporting the gas cylinder and it is to the provision of this support and the construction of the harness assembly that the following description is particularly directed. The respiratory system, which may be of any conventional form, will not be described and is omitted from the drawings.

Figure 6:
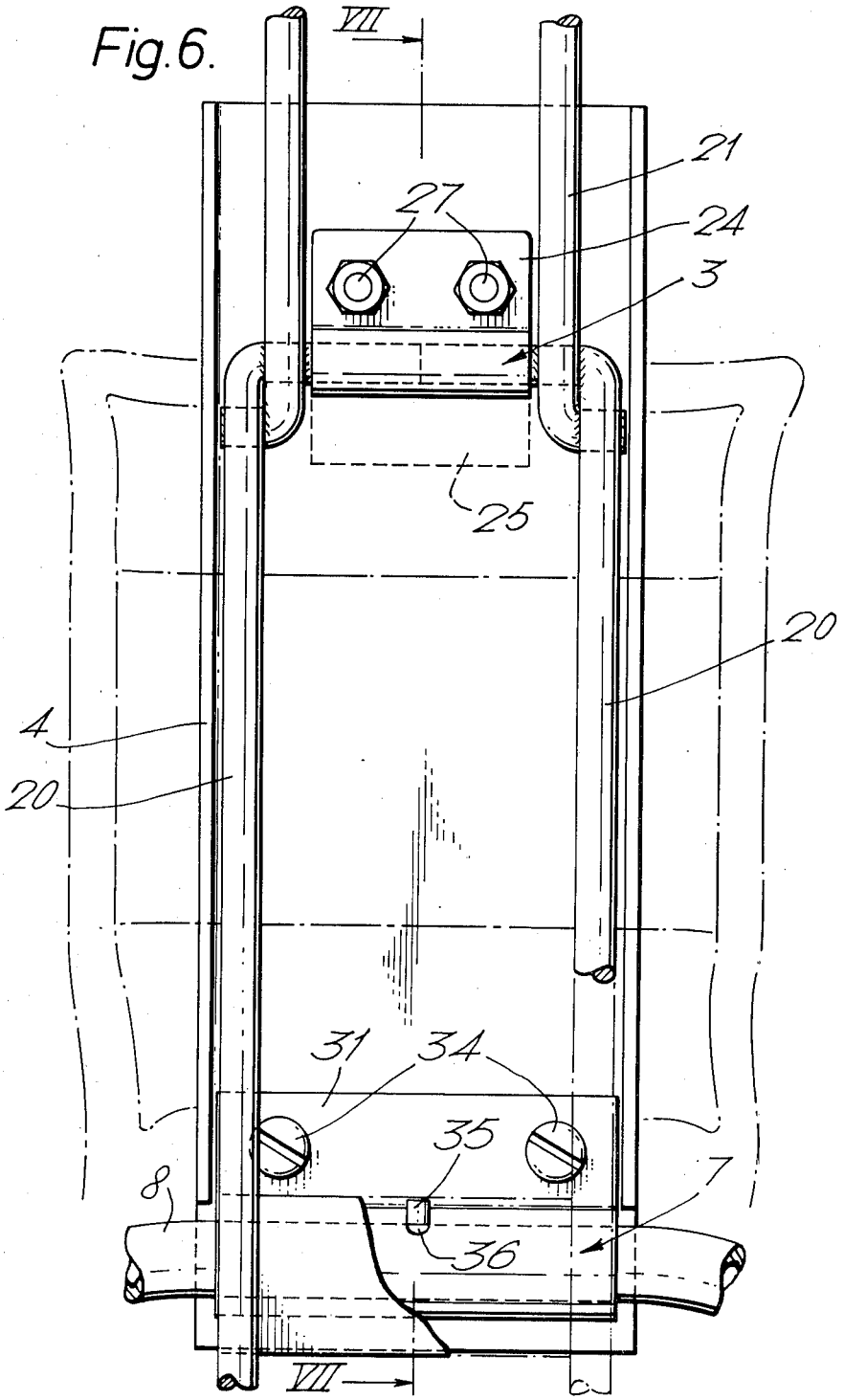
FIG. 6 is a rear elevation, to an enlarged scale, of the back-plate and associated parts of the harness assembly of FIGS. 1 to 5.
Figure 7:
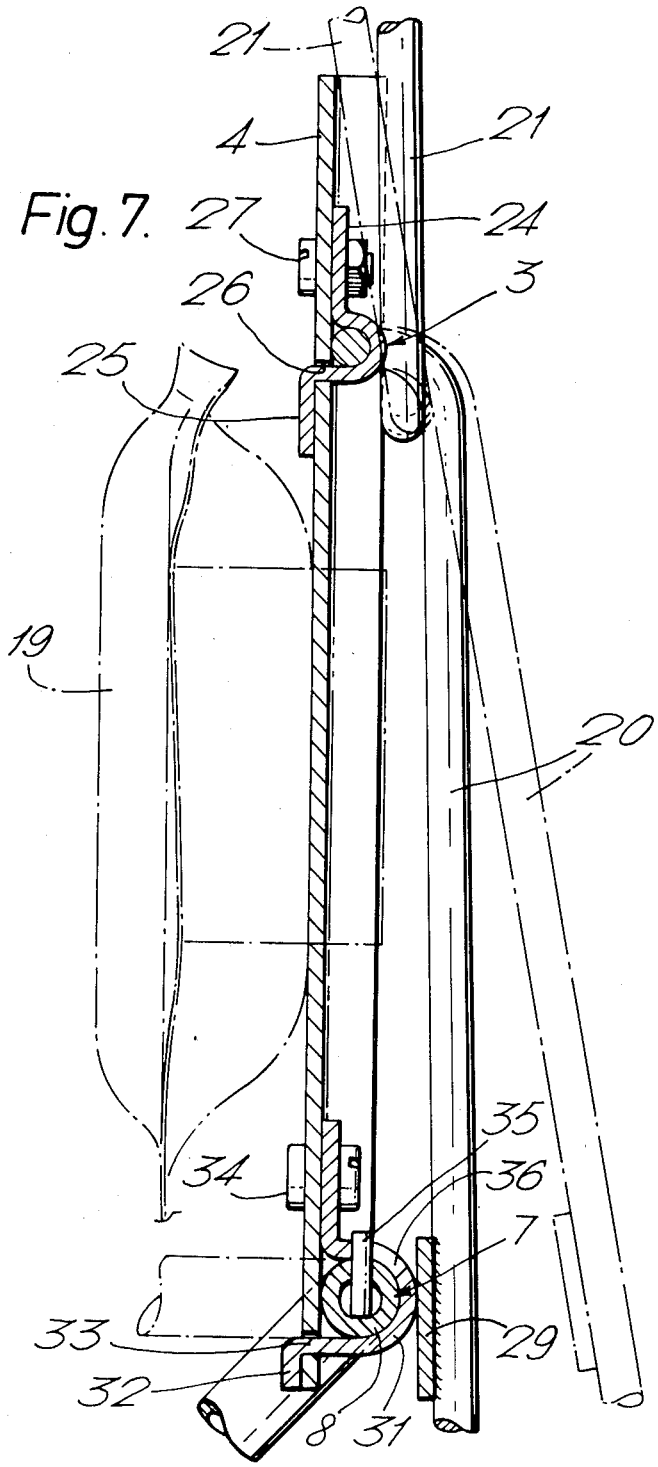
FIG. 7 is a section on the line VII—VII of FIG. 6.

Referring to FIGS. 1 to 5, the gas cylinder 1 is supported by a wire carrier 2 that is hinged at 3 (FIGS. 3, 6 and 7) to a metal channel section back-plate 4. When the apparatus is donned, the back-plate 4 extends down the user's back (FIGS. 1 and 2) from beneath the shoulder blades to the top of the lumbar region where it is hinged at 7 to the tubular-metal frame 5 of a pelvic girdle 6.

Figure 3:
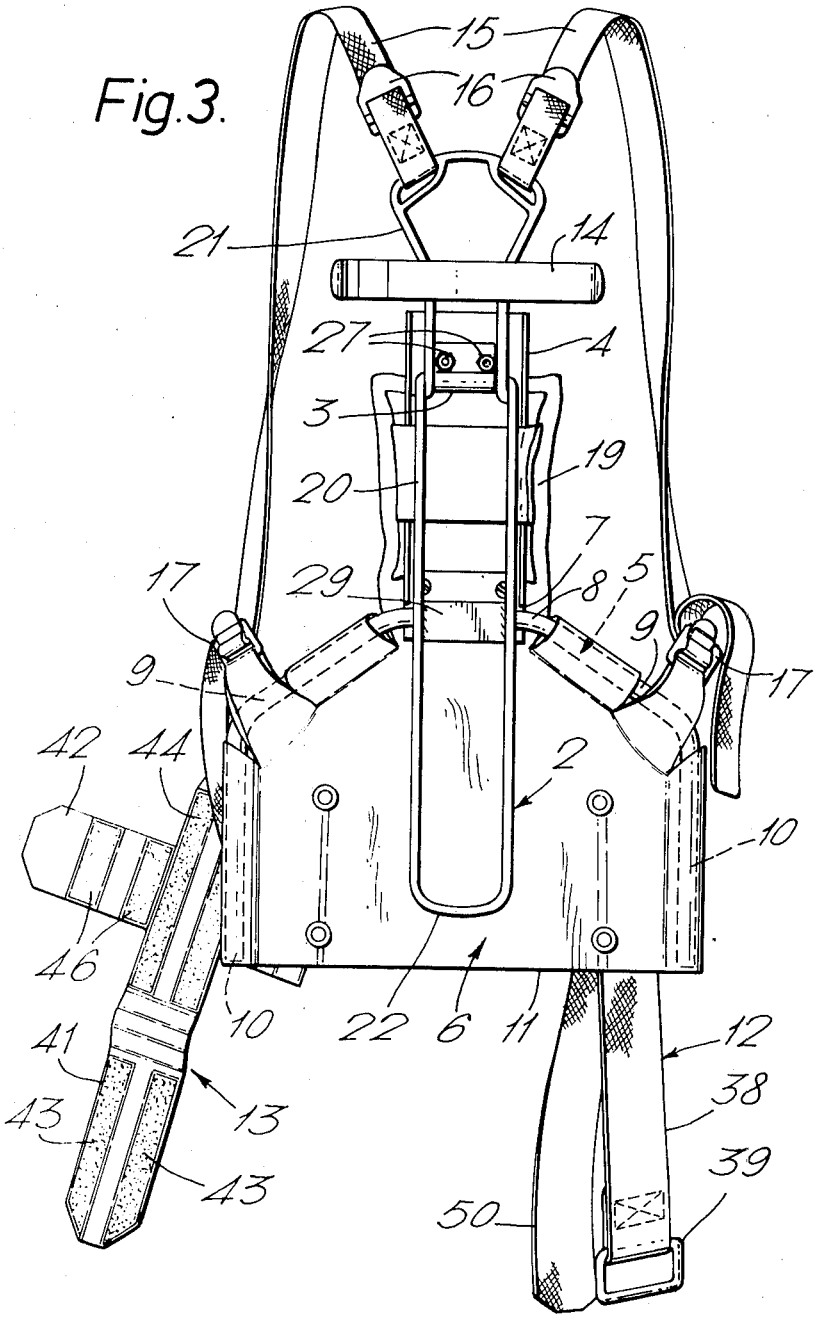
FIGS. 3 and 4 are respectively rear and front elevations of the harness assembly of FIGS. 1 and 2.

As best illustrated in FIG. 3, the frame 5 of the girdle 6 extends in both directions across the user's back from a short, central section 8 into downwardly and forwardly inclined sections 9. The sections 9 lead into respective sections 10 that project substantially vertically downwards on either side just rearwardly of the user's hips. A basket or cradle 11 of webbing or other material is attached to the frame 5 along the sections 9 and 10 to seat on the upper part of the user's buttocks. Straps 12 and 13, of webbing or other material, are secured to the cradle 11 itself within the compass of the frame 5 to pass round the front of the user beneath the waist, for belting the girdle 6 tightly onto the hips. When belted to the user in this way the girdle 6 enables the full load of the cylinder 1 on the carrier 2 to be supported almost entirely on the pelvis of the user, the loading applied from the carrier to the back-plate 4 through the upper hinge 3 being transferred through the lower hinge 7 to the frame 5 seated by the cradle 11 on the user's buttocks.

The cylinder 1, as secured to the carrier 2 by a retaining band 14, is pulled in towards the user's back at its upper end by two shoulder straps 15 of webbing or other material. Each strap 15 has a three-bar buckle 16 attached and is looped through the carrier 2 above the hinge 3 to run back through its buckle 16. From the buckles 16 the straps 15 run up over the user's shoulders through shoulder pads (not shown), and then down under the arms to engage in individual slide adjusters 17 attached to either side of the cradle 11 on the girdle 6. The straps 15, which are threaded back out of the way through buckles 18 (shown in FIG. 2 only), are tightened up on the slide adjusters 17 to pull the carrier 2, and with it the back-plate 4, in against the user's back; with the cradle 11 of the girdle 6 correctly seated on the buttocks little load is put on the shoulders by the straps 15. The cradle 11 is extended above the frame 5 into a pad 19 retaining on the back-plate 4 for comfort against the user's back.

By concentrating the greater part of the loading of the cylinder 1 on the buttocks the user is allowed considerable freedom of movement in the upper part of the body. By virtue of the lower hinging—at hinge 7—of the back-plate 4 to the frame 5 of the pelvic girdle 6, the user can bend forwardly, and to a small degree backwardly, at the waist without significant restriction. Also the upper hinging—at hinge 3—of the carrier 2 to the back-plate 4 enables the user to bend forwardly without restriction to a small degree at the shoulders. Furthermore, the absence of tightness of the harness across the chest allows almost complete freedom of arm and shoulder movement and substantially unrestricted breathing by the user. Moreover, the upper hinging allows limited freedom for the cylinder to hang vertically and so avoid unbalance of the user when bending backwardly, for example in reaching high above the head.

Figure 1:
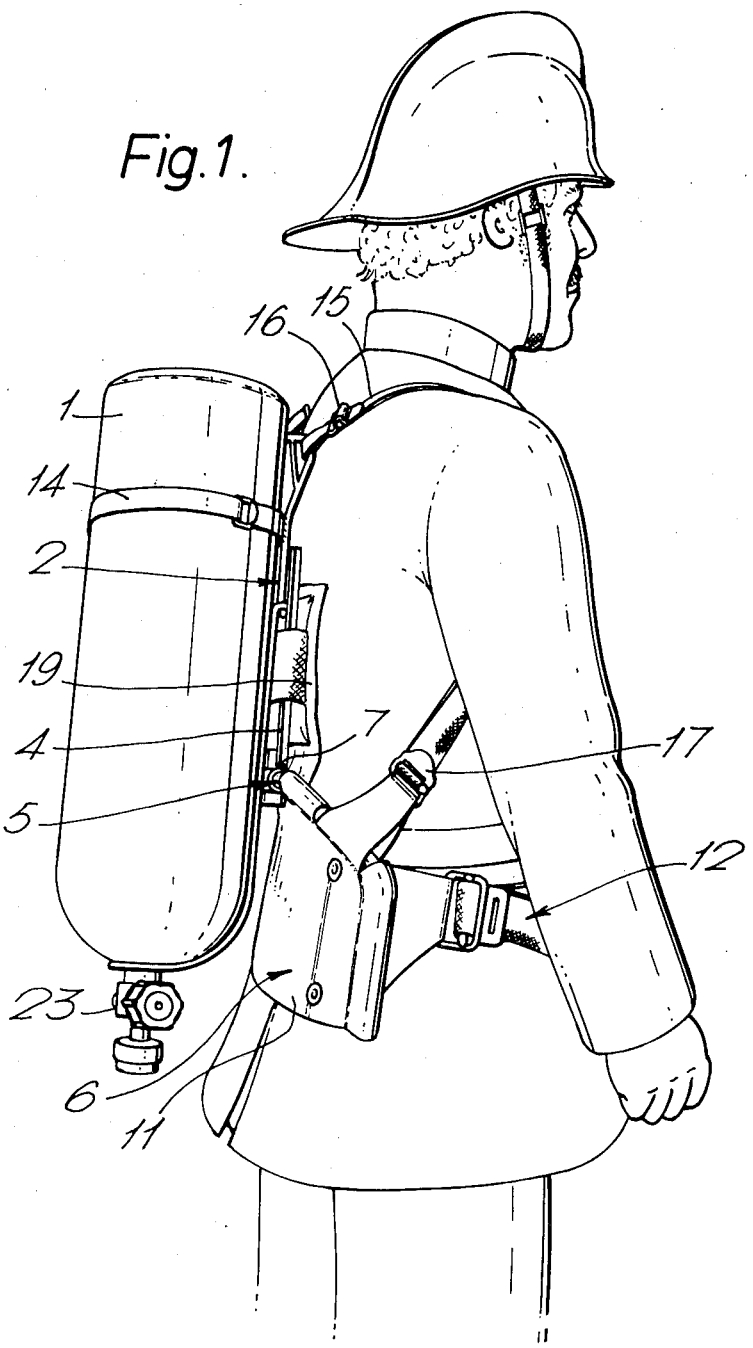
FIGS. 1 and 2 illustrate a first back-carrying harness assembly in use.
Figure 2:
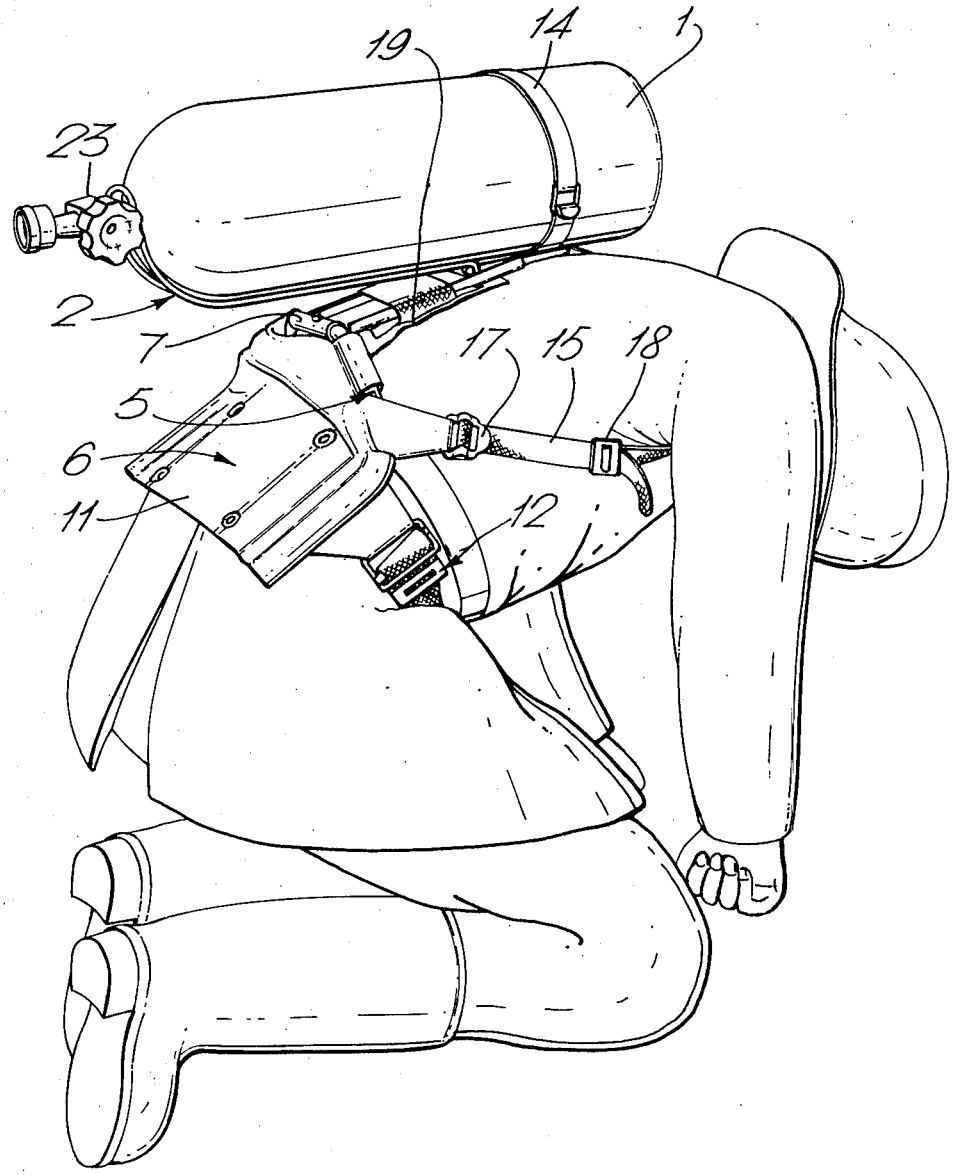

The combined effect of the upper and lower hinging with the location of the girdle 6 low down on the user's anatomy, as indicated above allows a considerable degree of freedom of movement to the user. In particular the user has a greater degree of freedom than with conventional forms of back-carrying harness employed with breathing apparatus, for bending over forwardly and (to a limited extent) backwardly from the waist, for crouching, for crawling—as illustrated in FIG. 2—and for adopting other attitudes and manners of proceeding appropriate to the duties of a fireman or other rescue worker in hazardous conditions where the use of breathing apparatus is required. It is of note in the latter respect that while wearing the described back-carrying harness assembly the user is not significantly hindered in taking up the attitudes and executing the procedures necessary for mouth-to-mouth and other methods of resuscitation.

Figure 5:
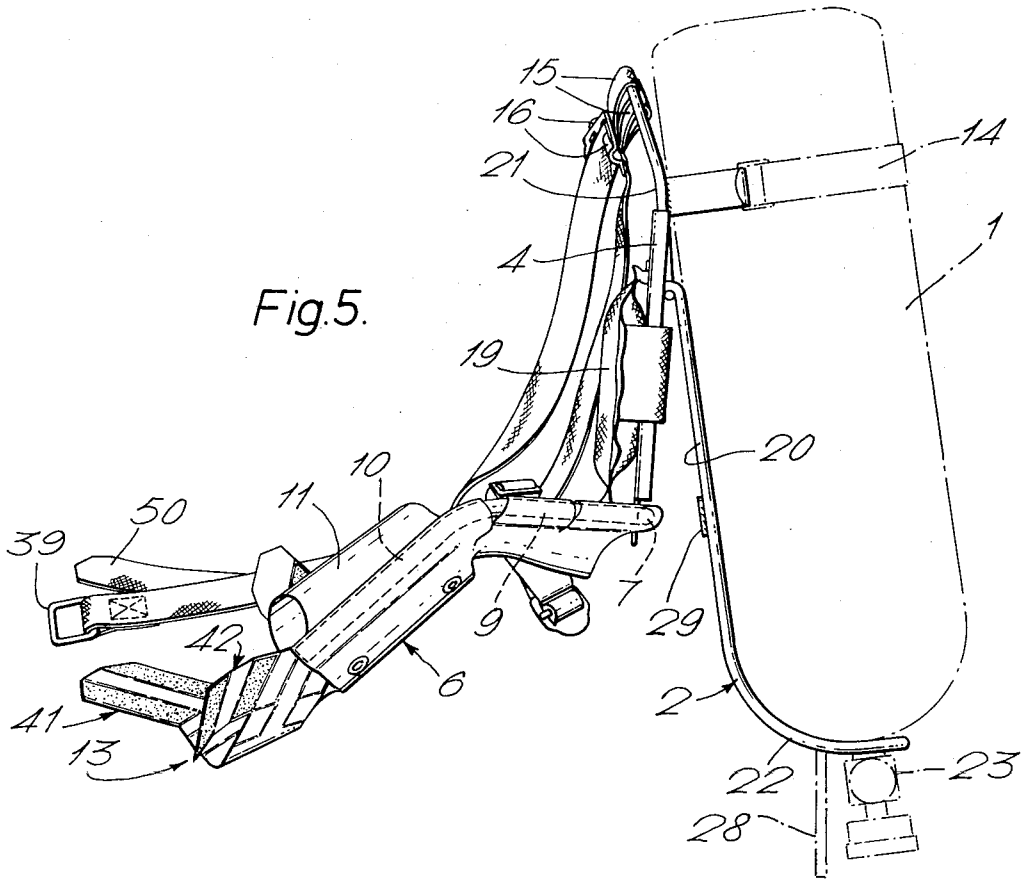
FIG. 5 is a side elevation of the harness assembly of FIGS. 1 to 4 as rested on the ground or other surface.

The provision of upper and lower hinging has the added advantage illustrated in FIG. 5 of enabling the back-carrying harness assembly, with or without the cylinder fitted, to be rested upright on the ground or other surface in a self-supporting manner, ready for inspection and donning; in order to avoid damage to the cylinder valve 23 or other cylinder attachments when this practice is adopted the carrier 2 preferably includes a depending foot 28 which takes the weight of the cylinder and prevents the cylinder attachment striking the ground. The assembly may be donned as with a jacket or coat by inserting one arm at a time into the straps 15, or by putting both arms through the straps 15 and lifting over the head.

Considering now constructional details of the back-carrying harness assembly, with particular reference to FIGS. 3 to 7, the carrier 2 is of plastics-coated wire in two sections 20 and 21. The main section 20 is fashioned as an elongate closed loop to run the length of the cylinder 1 downwardly from the upper hinge 3, turning rearwardly at its lower end 22 to support the cylinder's domed shoulder. The upper end of the section 20 is trapped to the plate 4 under a bracket 24 so as to define the hinge 3. The bracket 24 has a lip 25 that engages in a slot 26 (FIG. 7) of the plate 4 below, and is clamped to the plate 4 above, by bolts 27. The section 21 of the carrier, fashioned as an open loop extending above the hinge 3 and carrying the band 14, has its two free ends brazed to the section 20 on either side of the bracket 24; it is notable that even if the bond between the two sections 20 and 21 in this respect is broken, the section 20, carrying the load of the cylinder 1, is safely retained to the back-plate 4 by the bracket 24, thereby preserving the integrity of the carrier 2.

The two shoulder straps 15 are looped onto the carrier 2 above the band 14 so that the upper end of the carrier 2 can move forwardly with the straps 15, about the hinge 3, lifting the section 20 rearwardly away from the plate 4, as the wearer bends forward at the shoulders. The extent of freedom for such forward movement is limited (to, say, some ten to fifteen degrees) by eventual abutment of the section 21 with the top of the plate 4.

A resiliently-padded metal strip 29 extending across the section 20 provides a stop that cushions return of the carrier 2 to its normal substantially upright attitude. The strip 29 in this respect abuts with a bracket 31 that traps the central section 8 of the frame 5 to the plate 4 to define the hinge 7. The bracket 31 has a lip 32 that engages in a slot 33 (FIG. 7) of the plate 4 below the section 8 and is clamped to the plate 4 above, by bolts 34. A pin 35 carried by the section 8 extends into a slot 36 of the bracket so that the extent of relative hinging of the back-plate 4 and girdle 6 is limited (to say some thirty degrees) by the travel of the pin 35 from one end to the other of the slot 36.

Figure 4:
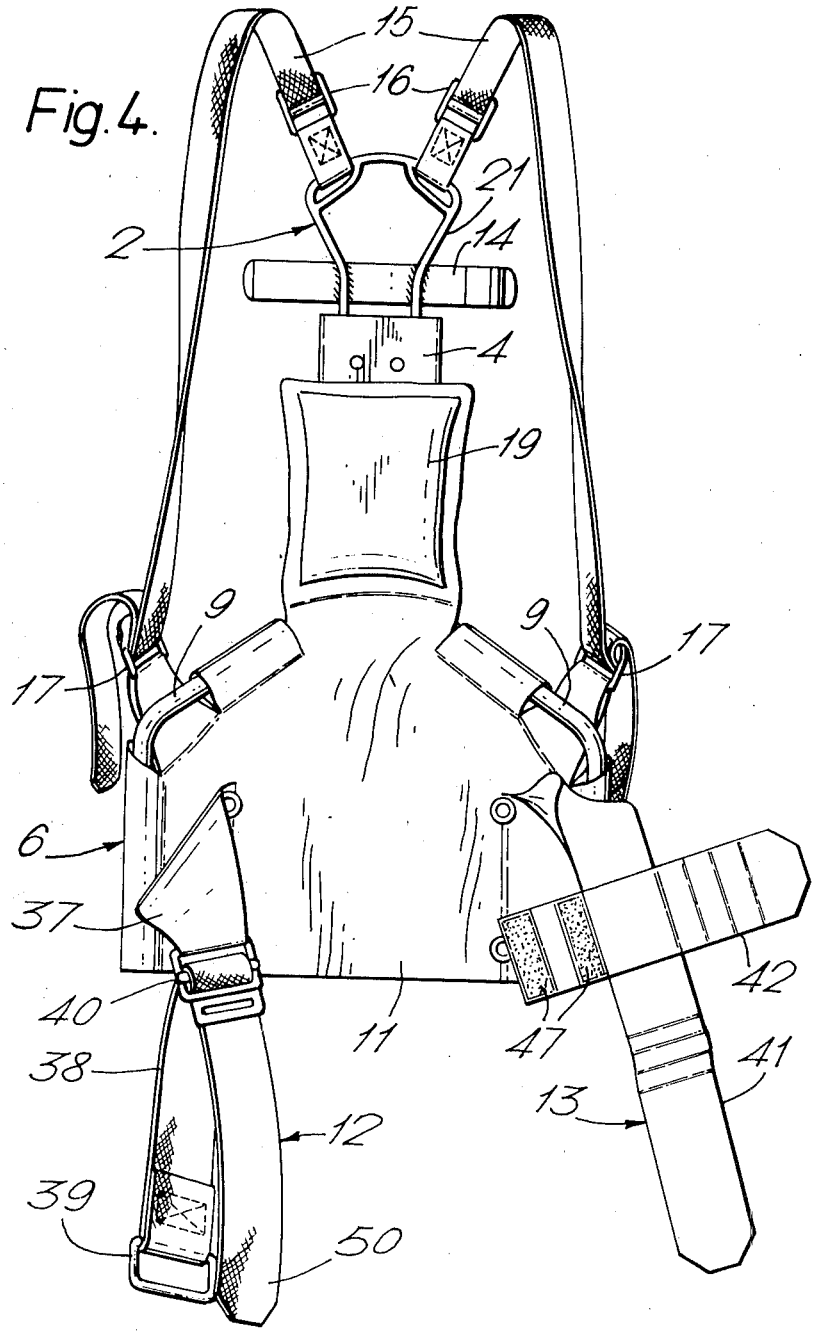

The straps 12 and 13 used for belting the girdle 6 on the user's pelvis are secured to the cradle 11 within the compass of the frame 5 so that the cradle 11 is pulled directly in to seat tightly onto the user's buttocks. The strap 12 as illustrated especially in FIG. 4, is in two parts, a first providing an attachment ear 37 to one side of the cradle 11 and the second a webbing belt 38 that has a buckle-loop 39 and is threaded through a slide-adjuster 40 on the attachment ear 37. The strap 13 on the other hand extends in one piece from the other side of the cradle 11 into a belt-part 41 for threading through the loop 39 and turning back along itself. A short strap 42 is attached to the inside face of the belt-part 41 for use in securing the turned-back portion firmly in place.

Figure 8:
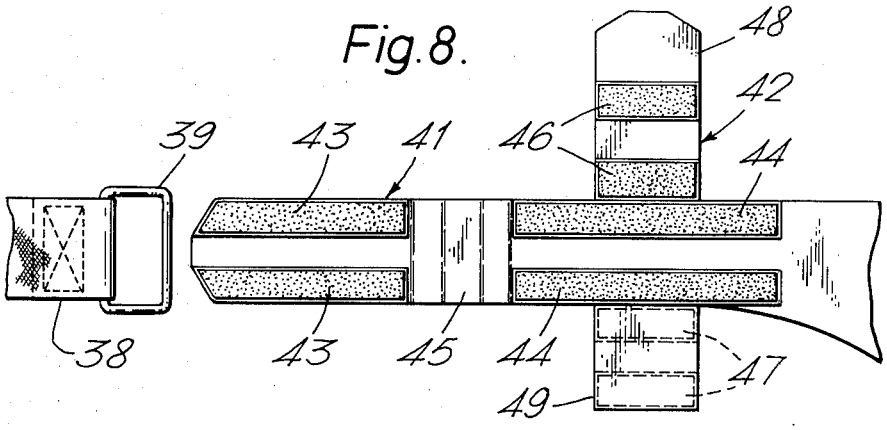
FIGS. 8 to 11 illustrate a strap-retention arrangement of the harness assembly of FIGS. 1 to 7 during successive stages in belting up the pelvic girdle of the assembly.

Referring now also to FIG. 8, two pairs of strips 43 and 44 of fibre material are attached to the belt-part 42 with the two strips 43 and 44 of one pair extending along the top margin in either direction from an intervening reinforced section 45, and the two strips 43 and 44 of the other pair extending correspondingly along the bottom margin. Two fibre strips 46 and two fibre strips 47 are attached respectively to the two flaps 48 and 49 of the strap 42 extending above and below the belt-part 41. The strips 46 and 47 extend transversely of the strap 35, with the strips 46 on the longer flap 48 attached to the outside and the strips 47 on the shorter flap 49 attached to the inside. All strips 43, 44, 46 and 47 are of a synthetic fibre material such as that sold under the trade mark VELCRO, formed of elements of upstanding and hook-ended fibres that adhere firmly to one another and are releasable from one another by stripping upwardly. (A single, wider strip of the material may be utilized in place of the two strips—43, 44, 46 and 47—in each case).

Figure 9:
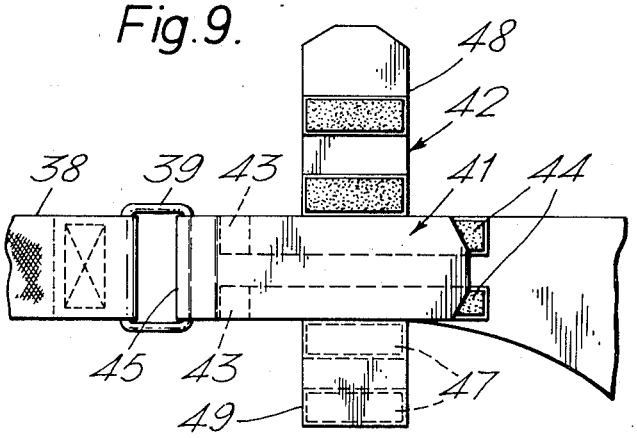
Figure 10:
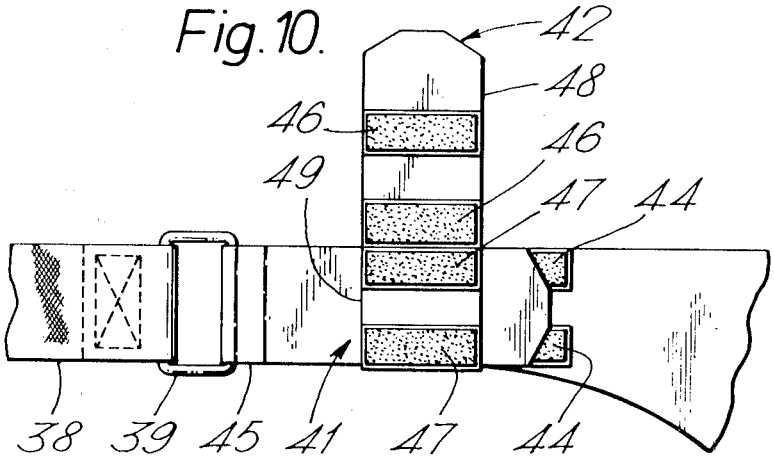

The straps 12 and 13 are retained together in belting up the girdle 6 by first inserting the belt-part 41 into the loop 39 to the reinforced section 45 before folding it back along itself face to face, as illustrated in FIG. 9. This lays the two fibre strips 43 and 44 of each pair upon one another to retain the belt-part 41 engaged via the loop with the belt 38. The flaps 48 and 49 are now utilized to protect against accidental stripping up of the threaded-through portion of the belt-part 41. In this respect the flap 49 is first folded up across the superposed portions of the belt-part 41 as illustrated in FIG. 10, and the flap 48 then folded down over it, as illustrated in FIG. 11, to lay the two fibre strips 46 upon the two fibre strips 47 and retain it there.

Figure 11:
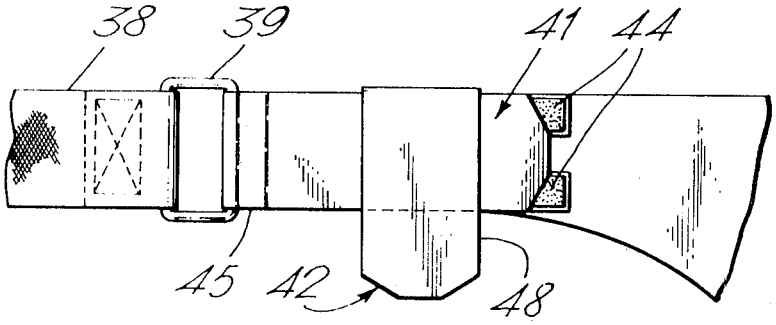

When strap retention is completed as illustrated in FIG. 11, tightness of the girdle 6 on the wearer is achieved by pulling the free end 50 (FIG. 4) of the webbing belt 38 up through the slide-adjuster 40. The belting provided can be readily released simply by lifting the flap 48 up to release the fibre strips 46 from the fibre strips 47, and then stripping the threaded-through portion of the belt-part 41 up to release the fibre strips 43 from the fibre strips 44 and allow the belt-part 41 to run back through the buckle-loop 39.

The absence of metal other than that of the buckle-loop 39, from the strap-retaining arrangement is especially advantageous in circumstances in which the back-carrying harness assembly is utilized in extremes of temperature.

Figure 12:
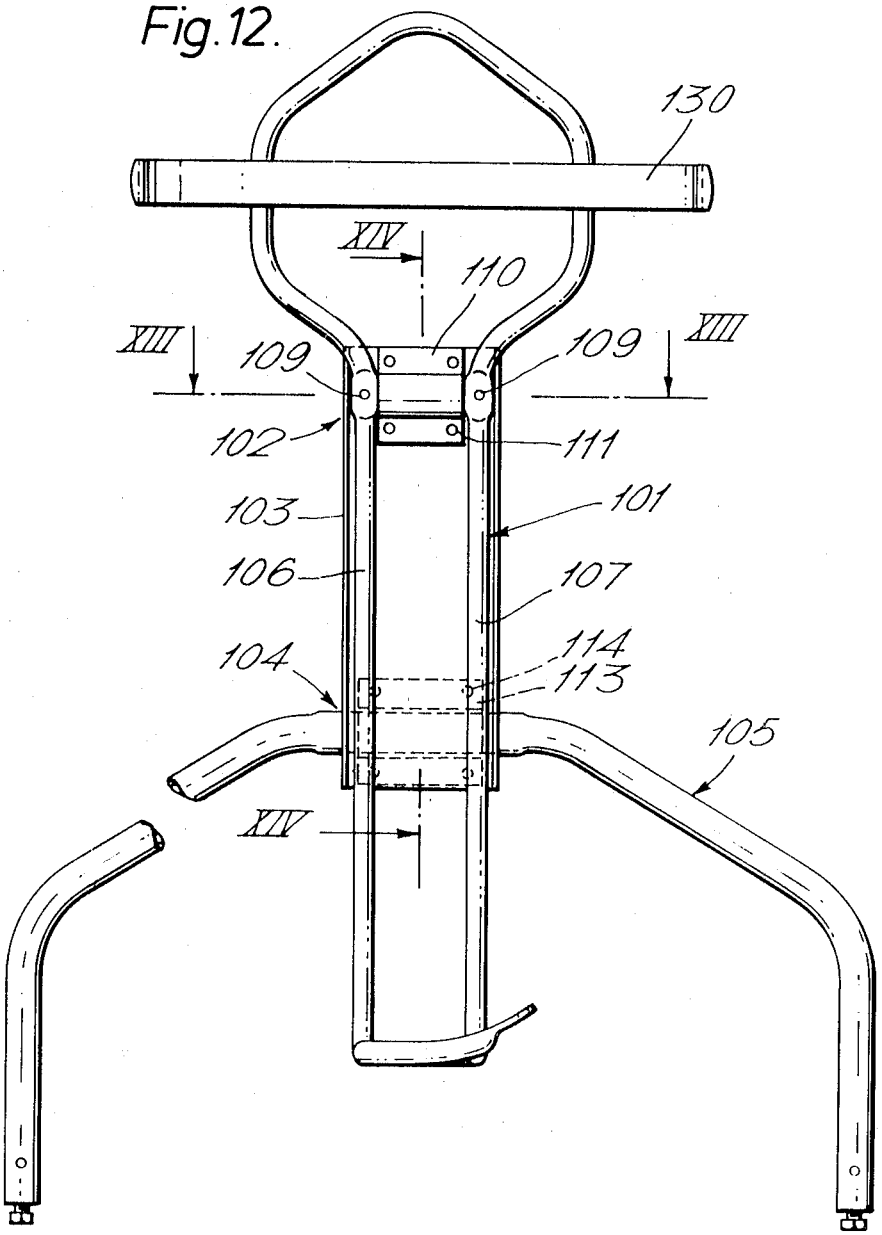
FIG. 12 is a rear elevation of the "skeleton" of a second back-carrying harness assembly.
Figures 13, 14:
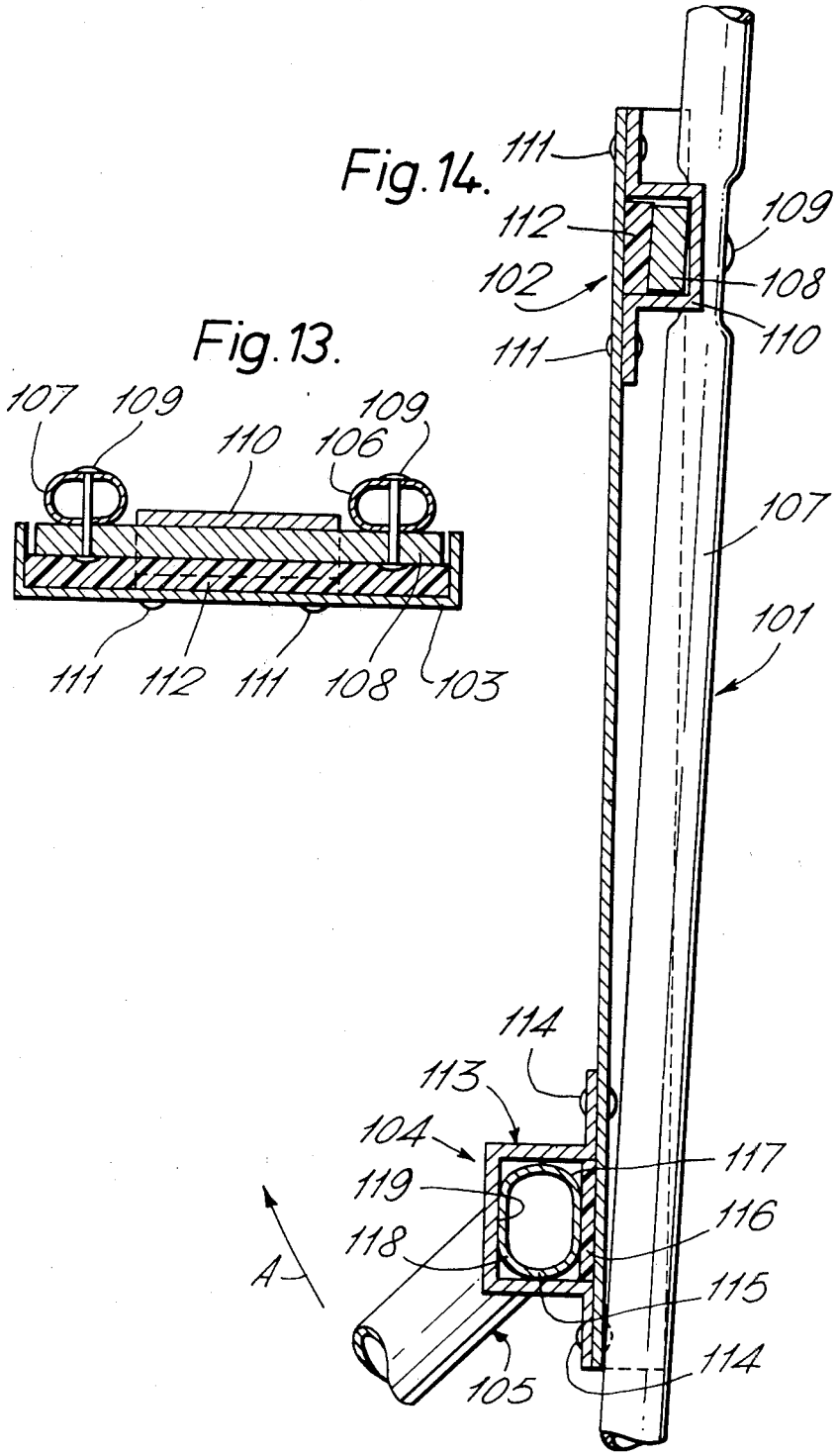
FIG. 13 is a section, to an enlarged scale, on the line XIII—XIII of FIG. 12.
FIG. 14 is a section, to an enlarged scale, on the line XIV—XIV of FIG. 12.

Turning now to FIGS. 12 to 14, these illustrate the "skeleton" of a second embodiment of a back-carrying harness assembly in accordance with the invention. In this case there is a tubular-metal cylinder carrier 101 hinged at 102 to a channel section metal back-plate 103, the back-plate in turn being hinged at 104 to the tubular-metal frame 105 of a pelvic girdle. The purpose and function of these components, and the manner in which they are harnessed to the body of the user, are all essentially the same as for the corresponding parts described above with reference to FIGS. 1 to 11, and description in this respect will accordingly not be repeated. The main structural difference between the embodiments, however, is in the formation of the two hinged connections 102 and 104 between the carrier and the back-plate and between the back-plate and the girdle, as described below.

The carrier 101 is formed from a single length of seamless steel tubing (preferably stainless steel or otherwise treated or coated to resist corrosion), fashioned into an elongate closed loop. In the region of its mounting to the back-plate 103, the tubing of each leg 106, 107 of the carrier is locally deformed by a pressing action from its original circular cross-section to a flattened cross-section as indicated in FIG. 13. A metal bar 108 of rectangular cross-section extends across the carrier between the deformed portions of the two legs, to which the bar 108 is secured by welding and rivets 109. This bar is trapped to the back-plate 103 by a bracket 110 disposed between the legs 106, 107 and secured to the back-plate by rivets 111. Furthermore, interposed between the bar 108 and back-plate 103 is a strip 112 of compressible elastomeric material. The effect of the form of connection thus provided between the carrier and back-plate is that while the two components are inseparable the carrier is permitted a limited degree of rocking motion relative to the back-plate by selective compression of the strip 112 by the bar 108 fast with the carrier. The limits of such motion are set by abutment of the carrier with the top or bottom end of the back-plate, the carrier being shown in FIG. 14 in the limiting condition in which it abuts the bottom end.

At the bottom end of the back-plate, a bracket 113, which is secured to the back-plate by rivets 114, traps the central section 115 of the girdle frame 105 to the back-plate. The frame 105 is of tubing similar to that of the carrier 101 (except of larger diameter) and its central section 115 is deformed by a pressing action from its original circular cross-section to a flattened cross-section as indicated in FIG. 14. As also shown, a strip 116 of compressible elastomeric material is interposed between the frame section 115 and the back-plate 103 within the bracket 113. The effect of the form of connection thus provided between the frame 105 and back-plate 103 is that while the two components are inseparable the frame is permitted a limited degree of rocking motion relative to the back-plate by selective compression of the strip 116 by its central section 115. The freedom for such motion is limited by the space available within the envelope of the bracket 113, bearing in mind also the presence of the strip 116, for the central section of the frame to rotate relative to the back-plate. Thus considering relative motion of the frame in the sense of arrow A, which occurs when the user bends forwardly from the waist, this will be limited when the central section of the frame rotates into the position in which its "corner" 117 fully compresses the adjacent part of the strip 116 against the back-plate 103, while the diametrically opposite "corner" 118 is in abutment with the top wall 119 of the bracket 113.

Figure 15:
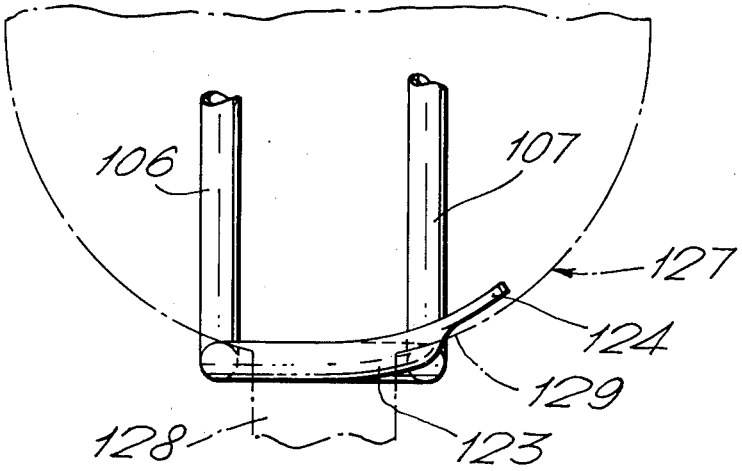
FIGS. 15, 16 and 17 are respectively rear elevation, plan and side elevation views, to an enlarged scale, of the lower end of the cylinder carrier of the harness assembly of FIG. 12.
Figure 16:
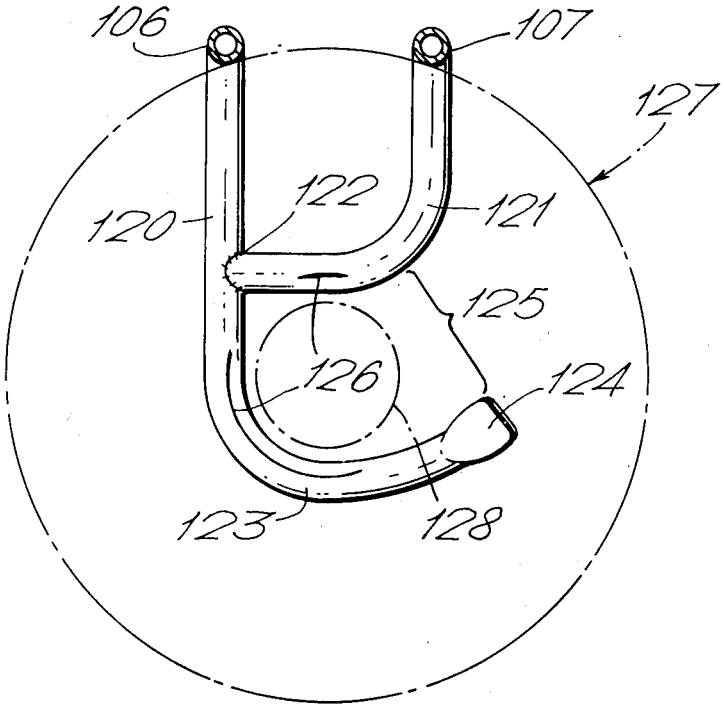
Figure 17:
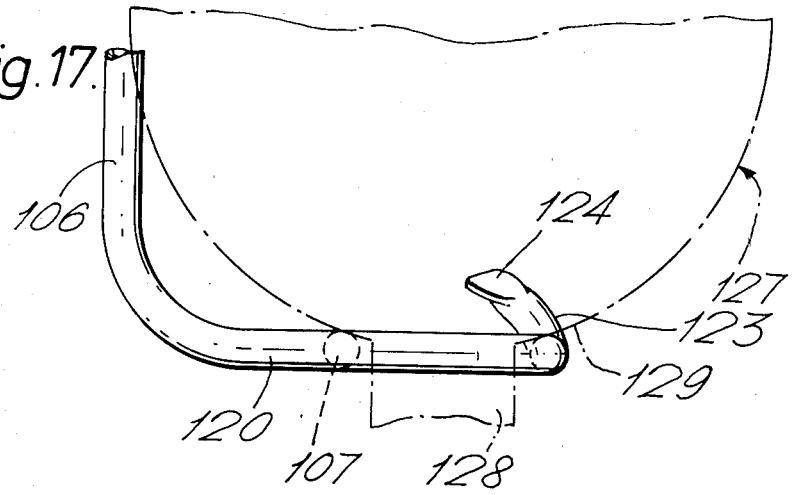

Returning now to the construction of the carrier 101, and referring to FIGS. 15 to 17, the legs 106 and 107 extend in parallel from the hinge 102 to the bottom end of the carrier, where they each turn rearwardly at 120, 121 and leg 107 loops round to be welded to leg 106 at 122. The leg 106 continues further rearwardly and is then curved laterally and upwardly at 123 to terminate in a flattened end 124. The geometry of the carrier thus defined facilitates the installation and support of a gas cylinder 127 in that, with the upper end of the cylinder steadied against the upper end of the carrier, the neck 128 of the cylinder can be passed laterally through the entrance 125 defined between the free end of the leg 106 and the looped part of the leg 107 while the shoulder 129 of the cylinder slides down the ramp provided by the curved part 123 of the leg 106 to seat stably upon the portions of the legs indicated by the shading 126 in FIG. 16. In particular this arrangement may permit a user of breathing apparatus incorporating this harness assembly to change gas cylinders unassisted and without having to doff the assembly. Retention of the cylinder is completed by means of the band 130 (FIG. 12) attached to the carrier 101 above the hinge 102.

Figure 18:
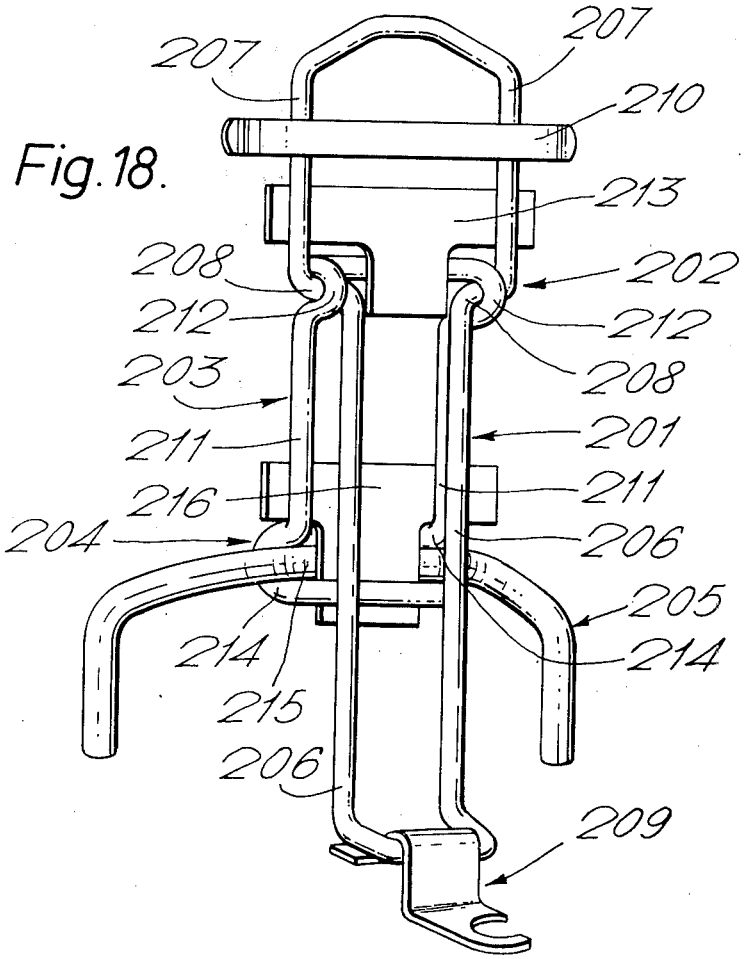
FIG. 18 is a three-quarters rear view of the "skeleton" of a third back-carrying harness assembly.

Turning finally to FIG. 18 this shows the "skeleton" of a further embodiment of a back-carrying harness assembly in accordance with the invention. In this case there is a wire cylinder carrier 201 fashioned in a single closed loop hinged at 202 to a member 203 in the form of a second wire loop and which corresponds to the back-plates of the earlier-described embodiments. The member 203 is in turn hinged at 204 to the wire frame 205 of a pelvic girdle. Once again, the purpose and function of these components, and the manner in which they are harnessed to the body of the user, are essentially the same as for the corresponding parts of the earlier-described embodiments, the main structural differences being in the form of the "back-plate" member 203 and the hinged connections.

The carrier 201 in this case has a main section comprising a pair of legs 206 and an upper section comprising a pair of legs 207 each of which joins with a respective leg 206 through a cranked portion 208. At their lower ends the legs 206 are welded to a cylinder mounting bracket 209 which, together with the band 210, provides for the location and support of a gas cylinder in accordance with the invention described in our copending United Kingdom Patent Application No. 7941338.

The member 203 is formed with a pair of parallel rails 211 which extend down the user's back when the complete assembly is donned, and which join together at their upper and lower ends to define a closed loop. At their upper ends the rails are formed with hook-like portions 212 which mate with respective cranked portions 208 of the carrier 201 to define the hinge 202. The integrity of the hinged connection between the member 203 and carrier 201 at this location is maintained by a T-shaped plate 213 the arms of which are welded to the legs 207 of the carrier while the upright of the plate extends over the upper horizontal section of the member 203 which joins its rails 211.

At their lower ends the rails 211 are formed with hook-like portions 214, which face in the opposite sense to the upper hook-like portions 212, and which mate with the centre section 215 of the girdle frame 205 to define the hinge 204. In this case the integrity of the hinged connection between the member 203 and the frame 205 is maintained by a T-shaped plate 216, the arms of which are welded to the rails 211 while the upright of the plate extends over the centre section of the frame 205 and under the lower horizontal section of the member 203 which joins its rails 211.

I claim:

1. A back-carrying harness assembly for supporting a load on the back of a user, comprising a rigid part which in use is arranged to lie against the back of the user; a carrier for the load hinged to said rigid part about a generally transverse axis in the region of the user's shoulder blades; and further harnessing including at least shoulder straps which are attached to said carrier at a position above the said hinge.

2. An assembly according to claim 1 wherein the carrier is adapted to support, in an inverted attitude, a gas bottle of cylindrical form having a domed shoulder leading to a neck, the carrier providing an open centred platform on which the shoulder can rest and with an entrance through which the neck can be passed transversely as the bottle is installed, the carrier further comprising means for restraining the upper part of the bottle when installed.

3. An assembly according to claim 1 comprising a second rigid part hinged to the first-mentioned rigid part about a generally transverse axis at a location below the first-mentioned hinge.

4. An assembly according to claim 3 wherein said shoulder straps are arranged to pass down over the shoulder of the user to be attached to said second rigid part.

5. An assembly according to claim 3 wherein the first-mentioned rigid part comprises a plate and said second rigid part comprises a frame having a transverse portion of circular cross-section, and further comprising a bracket of complementary form to said transverse portion which traps said portion against the plate thereby to define the second-mentioned hinge.

6. An assembly according to claim 3 wherein said second rigid part constitutes the frame of a pelvic girdle and is hinged to the first-mentioned rigid part in the vicinity of the user's lumbar region.

7. An assembly according to claim 3 comprising means clamping said second rigid part against the first-mentioned rigid part, and a resiliently compressible element interposed between the second and first-mentioned rigid parts, the second rigid part being permitted to hinge relative to the first-mentioned rigid part by compression of said interposed element.

8. An assembly according to claim 7 wherein the first-mentioned rigid part comprises a plate and the second rigid part comprises a frame having a transverse portion of non-circular cross-section which portion is clamped against the plate with the resiliently compressible element interposed therebetween.

9. An assembly according to claim 6 wherein said frame has an upper portion to extend transversely of the user's back and further portions to extend downwardly therefrom on both sides in the region of the user's hips, a flexible cradle being provided within the frame to seat on the upper part of the user's buttocks for supporting at least a substantial proportion of the load carried by the carrier.

10. An assembly according to claim 1 wherein said rigid part comprises a plate and the carrier comprises a frame having a transverse portion of circular cross-section, and further comprising a bracket of complementary form to said transverse portion which traps said portion against the plate thereby to define the first-mentioned hinge.

11. An assembly according to claim 1 comprising means clamping the carrier against the rigid part, and a resiliently compressible element interposed between the carrier and rigid part, the carrier being permitted to hinge relative to the rigid part by compression of said interposed element.

12. An assembly according to claim 11 wherein the rigid part comprises a plate and the carrier comprises a frame having a transverse portion of non-circular cross-section which portion is clamped against the plate with the resiliently compressible element interposed therebetween.

13. An assembly according to claim 1 wherein the rigid part comprises a frame in the form of an elongate closed loop.

* * * * *